US007152760B1

(12) United States Patent
Peabody

(10) Patent No.: US 7,152,760 B1
(45) Date of Patent: Dec. 26, 2006

(54) TAMPER-EVIDENT TARE CAP

(76) Inventor: Steven R. Peabody, P.O. Box 207, Zionsville, IN (US) 46077

( * ) Notice: Subject to any disclaimer, the term of this patent is extended or adjusted under 35 U.S.C. 154(b) by 153 days.

(21) Appl. No.: 10/909,956

(22) Filed: Aug. 3, 2004

(51) Int. Cl.
*B67B 5/00* (2006.01)
*B65D 47/36* (2006.01)

(52) U.S. Cl. ..... 222/153.07; 222/541.6

(58) Field of Classification Search ..... 222/1, 222/3, 153.05, 153.06, 153.07, 541.6
See application file for complete search history.

(56) References Cited

U.S. PATENT DOCUMENTS 4,437,593 A * 3/1984 Bullock, III ..... 222/153.07
4,595,123 A 6/1986 Libit
4,711,363 A 12/1987 Marino
5,579,943 A 12/1996 Johnson
5,769,277 A 6/1998 Elliot
6,073,809 A 6/2000 Long, Jr.
6,655,553 B1 12/2003 Staniszewski
6,685,061 B1 2/2004 Wolf et al.
2002/0104852 A1 * 8/2002 Staniszewski et al. . 222/153.07

* cited by examiner

*Primary Examiner*—Joseph A. Kaufman
(74) *Attorney, Agent, or Firm*—Richard L. Huff

(57) ABSTRACT

A tamper-evident cap for a threaded outlet includes a top and a cylindrical side. The tamper-evident cylindrical side is initially engaged with threads of a valve outlet to prevent axial displacement of the cylindrical side with respect to the valve outlet. The cylindrical side includes a plurality of undercut barbs to prevent manipulation of the cap to an open condition. The cylindrical side includes a frangible tear strip connected to a pull tab and connected to the remainder of the cylindrical side by lines of weakness, which tear strip arranged to be torn to facilitate displacement of the cylindrical side to permit manipulation of the cap to an open condition.

10 Claims, 3 Drawing Sheets

TAMPER-EVIDENT TARE CAP

CROSS-REFERENCE TO RELATED APPLICATIONS

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to caps for threaded outlets. More particularly, it relates to tare caps for valve outlets. The caps have been modified so as to make it possible to put the cap on the threaded outlet, but impossible to remove without breaking a tear strip. The breaking of the tear strip makes it possible for the owner to determine that the threaded outlet has been used by an unauthorized individual.

2) Description of the Related Art

A variety of caps have been developed or proposed wherein an initial opening of a lid or a dispensing spout structure provides visual evidence of such an occurrence—even after the lid or spout has been subsequently closed.

U.S. Pat. No. 4,595,123, issued to Libit Jun. 17, 1986, discloses a tamper-evident closure cap having a pivotable stopper closing a cap top orifice. The stopper has an integral flange overlying portions of the top and extending behind the pivotable member to preclude pivoting of the pivotable member. The flange is removable from the pivotable member and indicia formed in the container top underlying the flange is made visible by removal of the flange.

U.S. Pat. No. 4,711,363, issued to Marino Dec. 8, 1987, discloses a tamper-evident closure having a multiple cap configuration intricately joined to a closure by a live hinge. A secondary cap is formed within the first cap with frangible tamper-evident strips and a secondary live hinge. A tubular plug depends from the underside of the secondary cap and is capable of going into a dispenser opening within the closure. Assembly pins secure the cap to the closure and an annular rib on the tubular plug forms a seal around the dispensing opening when the tubular plug is in a closed position and holds the secondary cap and plug in the closed position once the frangible tear strips are broken.

U.S. Pat. No. 5,579,943, issued to Johnson Dec. 3, 1996, discloses a dispensing closure lid having a tear-away tab for use with a container. The tab is configured with an outwardly extending grasping member. The tab is defined by a distinct sequence of slits and perforations wherein the slits have a greater length than the perforations. The specific sequence of slits and perforations facilitates removal of the tab from the container mouth and provides for a clean separation of the tab from the land surface of the container and the remaining lid without tearing into the lid.

U.S. Pat. No. 5,769,277, issued to Elliot Jun. 23, 1998, discloses a container and a closure including a base. The base includes a body for mounting to the container, and the body defines a dispensing orifice. A tamper-evident seal initially closes the dispensing orifice. The seal has a removable central portion occluding the orifice and at least a first frangible web defining a closed tear path lying in a plane connecting the sealed central portion to a surrounding part of the closure. The sealed central portion includes a hollow projection having a base located in the plane with one part of the base closer to the first frangible web than is any other part of the base. An outwardly directed force of sufficient magnitude applied to the projection will produce a tear which extends through the first frangible web at a point on the first frangible web closest to the one part of the projection base. The tear thereafter propagates from that point around the seal central portion so as to separate the sealed central portion from the closure and thereby open the seal.

U.S. Pat. No. 6,073,809, issued to Long, Jr. Jun. 13, 2000, discloses a substantially leak proof tamper-evident container closure that combines a reusable, push-pull spout with a snap-on tamper evident closure which is substantially tamper proof. The closure has first and second locking members characterized by the first locking member having an inward flange with an upturned locking edge forming an annular groove in the flange. The pour spout with an opening therein which is partially closed by a second top having a secondary opening therein and a plug space above it with upwardly angled legs is formed integrally with the closure. Integrated into the periphery of the secondary opening is at least one annular flange. The annular flanges engage and create a sealing contact with the annular surface of the plug to provide a seal which is leak proof after many uses. The lower edge of the pour spout contains a tamper-evident band to indicate if the pour spout has been tampered with.

U.S. Pat. No. 6,655,553, issued to Staniszewski et al Dec. 2, 2003, discloses a tamper-evident assembly including a cap and a surrounding tamper-evident cylindrical side. The tamper-evident cylindrical side is initially engageable with a retaining element of the container located below the cap to prevent axial upward displacement of the cylindrical side with respect to the container. The cylindrical side includes a retention member overlying the cap to prevent manipulation of the cap to an open condition. The cylindrical side also includes a frangible tear strip arranged to be torn to facilitate removal of the cylindrical side to permit manipulation of the cap to an open condition.

U.S. Pat. No. 6,685,061, issued to Wolf et al Feb. 3, 2004, discloses a tamper-evident closure assembly for a valve outlet of a pressurized container. The closure includes a cap which rotatably engages the outlet. A tamper-evident ring is carried by the cap and has at least one projection. Rotation of the cap in a cap removal direction is opposed by engagement of the projections with a surface of the associated outlet until a portion of the ring or cap breaks, allowing the cap to be removed from the associated outlet.

While the prior tamper-evident closures are satisfactory for their purposes, they are more complex than necessary. They have more parts than is required. The parts they do have are complicated in nature and require intricate machining for producing the molds for manufacturing the closures.

BRIEF SUMMARY OF THE INVENTION

The present invention is directed to a tamper-evident cap for any threaded outlet which maintains the beneficial tear strips of the prior devices while being extremely simple in design and having low manufacturing costs.

The cap is made up of a flat top and a generally cylindrical sidewall. The sidewall contains a frangible tear strip connected to a pull tab. The sidewall further contains a plurality of undercut barbs that allow the cap to be slipped on the threaded outlet with ease but impossible to remove without breaking the tear strip, thus allowing the owner to see that the cap has been removed.

DETAILED DESCRIPTION OF THE INVENTION

The dispensing system of this invention is suitable for use with a variety of conventional or special containers having various designs, the details of which, although not illustrated or described, would be apparent to those having skill in the art and an understanding of such containers. The propane container, per se, described herein forms no part of some aspects of the invention and therefore is not intended to limit the present invention. It will also be understood by those of ordinary skill that novel and non-obvious inventive aspects are embodied in the described exemplary closure systems alone.

Figure 1:
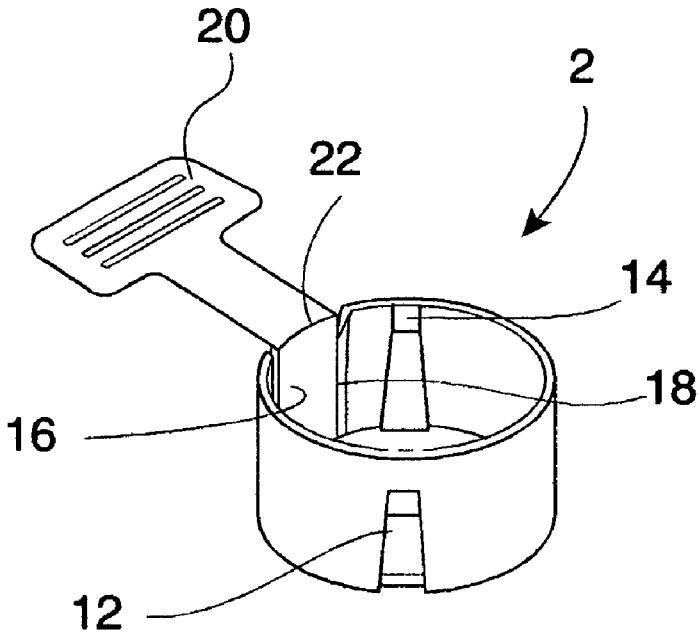
FIG. 1 is an elevational perspective view of the cap of the present invention.
Figure 2:
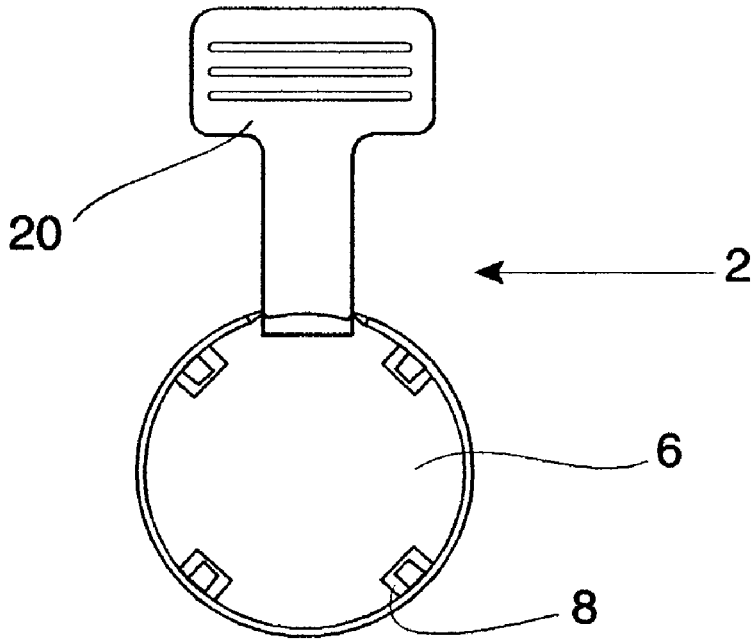
FIG. 2 is an elevational bottom view of the cap of the present invention.
Figure 3:
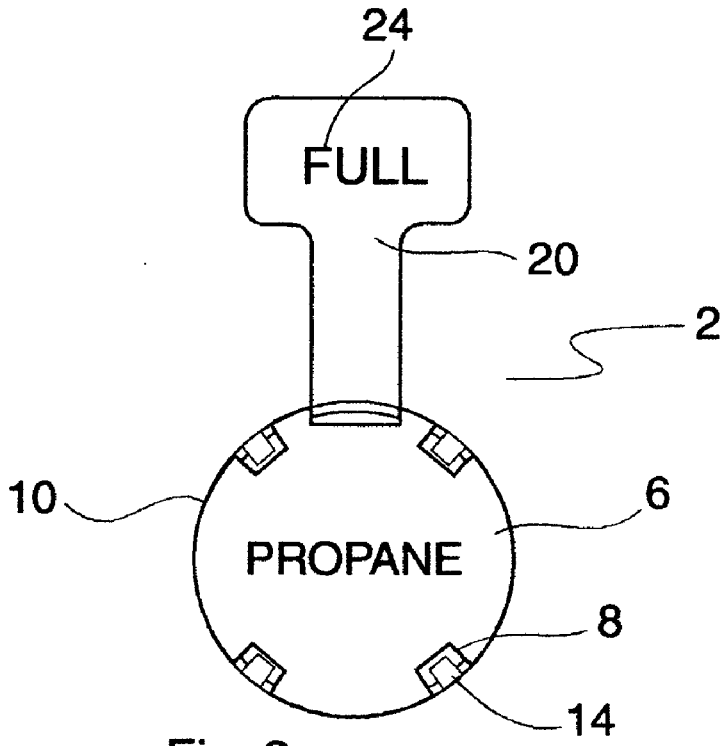
FIG. 3 is an elevational top view of the cap of the present invention.
Figure 4:
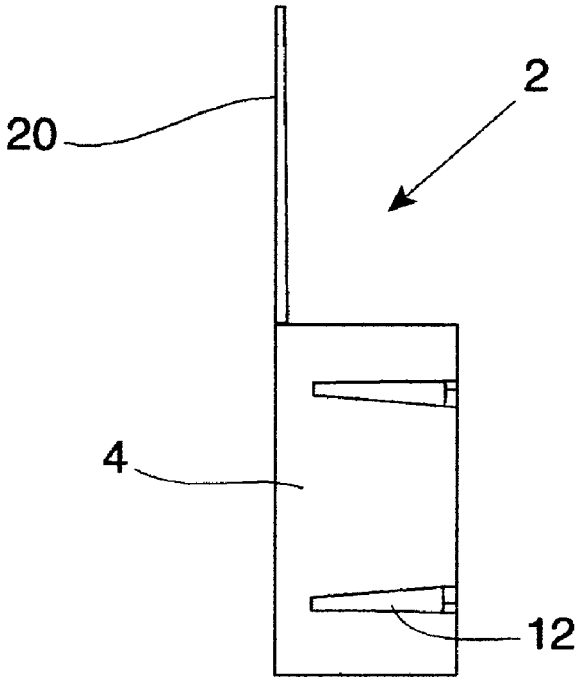
FIG. 4 is an elevational side view of the cap of the present invention.
Figure 5:
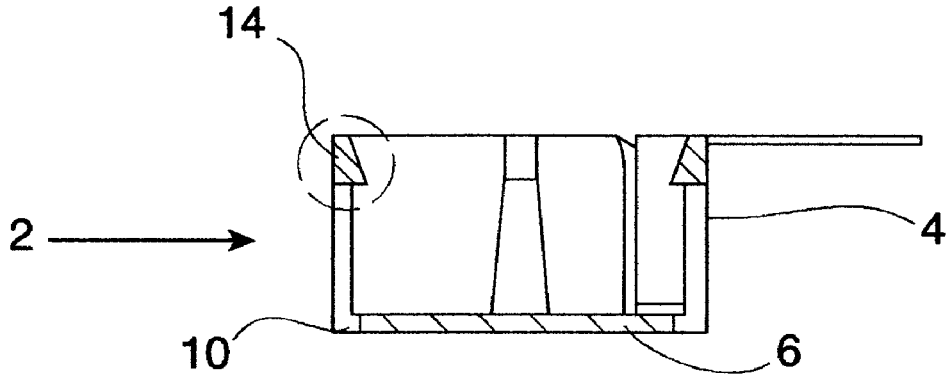
FIG. 5 is a cross-sectional view of the cap of the present invention.
Figure 6:
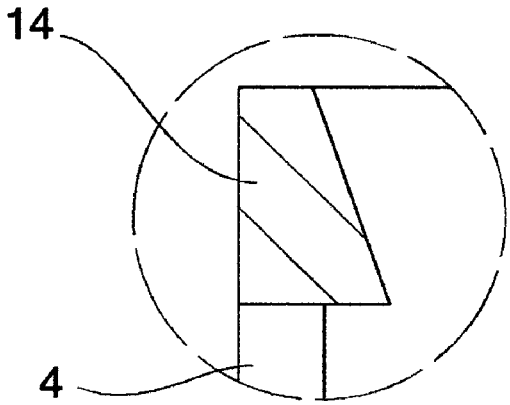
FIG. 6 is a magnified cross-sectional view of an undercut barb of the cap.

An exemplary embodiment of a cap 2 according to the invention is illustrated in FIGS. 1–5. The cap 2 is adapted to engage a threaded outlet (not shown), preferably the threaded outlet of a propane tank. The cap 2 includes a tamper-evident cylindrical side 4 and a top 6. The cap 2 is configured to prevent access to the contents of the container having the threaded outlet until the cap 2 is disengaged from the threads.

The tamper-evident cap 2 surrounds the threaded outlet. The top 6 of the cap 2 is flat and includes a plurality of cut-away areas 8 to promote flexibility. The top 2 abuts at its perimeter 10 with the cylindrical side 4. The cylindrical side 4 contains a plurality of cut-away areas 12 to promote flexibility. There is a plurality of, preferably four, cantilevered undercut barbs 14 extending radially inwardly from the cylindrical side 4.

The cylindrical side 4 includes a frangible tear strip 16 which is bounded on each side by a line of weakness 18 so that the lines of weakness 18 define the tear strip 16 therebetween. A pull tab 20 extends perpendicularly (radially) from the end 22 of the tear strip 16 opposite the top 6 outwardly from the cap 2. The pull tab 20 can carry molded or other indicia 24 giving opening instructions or other information.

The lines of weakness 18 can be made frangible in a number of ways, including forming the lines 18 with a reduced thickness, forming the lines 18 as a through cut with intermittently arranged bridging webs, forming the lines 18 as a plurality of perforations, etc. The lines 18 need not be linear, but can be curved or inflected. The two lines 18 need not be parallel. The undercut barbs 14 allow the cap 2 to be slipped onto a threaded outlet easily by simply forcing the cap 2 over the threads. The flexibility of the cap 2 coupled with the inward slant and flexibility of the undercut barbs 14 is such that the cap 2 may be put on the threaded outlet with little effort. Once the undercut barbs 14 are pushed past the threads, the geometry and elasticity of the undercut barbs 14 allow the undercut barbs 14 to snap into place, holding the cap 2 firmly in place. As the undercut barbs 14 are at the same distance from the top 6 of the cap 2, the cap 2 cannot be removed by twisting and the cap 2 can only be removed by removing the tear strip 16.

For the cap 2 to be initially opened, the cylindrical side 4 must be removed. The pull tab 20 is grasped and the tear strip 16 is pulled outwardly to tear the cylindrical side 4 along the lines of weakness 18. After the tear strip 16 is removed the cylindrical side 4 can be spread open to be removed from the threaded outlet. With the tear strip 16 missing, the cylindrical side 4 can be spread sufficiently in the tangential or radial direction to facilitate removal of the cylindrical side 4 axially, or radially, over the threaded outlet.

In the above manner, the tamper-evident cylindrical side 4 of the cap 2 prevents unauthorized, undetected removal of the cap 2 from the threaded outlet.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A tamper-evident cap comprising a substantially closed top, an open bottom, and a cylindrical side connecting the top and the bottom, the cylindrical side having a tear strip and a plurality of radially inwardly extending undercut barbs, which barbs have top and bottom ends, wherein the barbs are connected to the cylindrical side substantially adjacent to the bottom and extend inwardly and upwardly so that the top end is at a distance from the cylindrical side, the tear strip being attached at the end opposite the top to a pull tab.

2. The cap of claim 1, wherein the top has a plurality of cut-away areas.

3. The cap of claim 2, wherein the cylindrical side has a plurality of cut-away areas.

4. The cap of claim 1, wherein there are lines of weakness defining the tear strip.

5. The cap of claim 1, wherein the undercut barbs are at the same distance from the top of the cap.

6. A method which comprising a) applying a tamper-evident cap to a threaded outlet, said cap comprising a substantially closed top, an open bottom and a cylindrical side connecting the top and the bottom, the cylindrical side having a tear strip and a plurality of radially inwardly extending undercut barbs, which barbs have top and bottom ends, wherein the barbs are connected to the cylindrical side substantially adjacent to the bottom and extend inwardly and upwardly so that the top end is at a distance from the cylindrical side, the tear strip being attached at the end opposite the top to a pull tab and b) pulling the pull tab to remove the tear strip and enable the cap to be removed from the threaded outlet.

7. The method of claim 6, wherein the top has a plurality of cut-away areas.

8. The method of claim 7, wherein the cylindrical side has a plurality of cut-away areas.

9. The method of claim 6, wherein there are lines of weakness defining the tear strip.

10. The method of claim 6, wherein the undercut barbs are at the same distance from the top of the cap.

* * * * *